United States Patent [19]

Gaffney

[11] 4,007,960

[45] Feb. 15, 1977

[54] RECLINING ELEVATOR CHAIR

[76] Inventor: Edward J. Gaffney, N. 26 W. 27293 Highway SS, Pewaukee, Wis. 53072

[22] Filed: Apr. 30, 1975

[21] Appl. No.: 573,209

[52] U.S. Cl. ..... 297/71; 297/330; 297/342; 297/DIG. 10

[51] Int. Cl.[2] ..... A47C 1/02

[58] Field of Search ..... 297/71, 316, 322, 330, 297/340–342, 347, 348, 361, 362, DIG. 10

[56] References Cited

UNITED STATES PATENTS

| | | | |
|---|---|---|---|
| 3,138,402 | 6/1964 | Heyl, Jr. et al. | 297/330 X |
| 3,147,038 | 9/1964 | Barabas | 297/316 X |
| 3,596,991 | 8/1971 | Mckee et al. | 297/DIG. 10 X |
| 3,640,566 | 2/1972 | Hodge | 297/DIG. 10 X |
| 3,851,917 | 12/1974 | Horstmann et al. | 297/DIG. 10 X |
| 3,881,771 | 5/1975 | Amstutz | 297/71 |

*Primary Examiner*—Ramon S. Britts
*Assistant Examiner*—William E. Lyddane
*Attorney, Agent, or Firm*—Joseph P. House, Jr.

[57] ABSTRACT

A reclining elevator chair having a tiltable back, an extendible leg rest, and means for raising the seat and simultaneously tilting it forwardly to assist arthritic or other partially disabled persons in leaving the chair. A power-driven ram tilts the back and extends and retracts the leg rest in one mode of operation. In a second mode of operation, the same ram raises the seat and tilts it forwardly. The first mode of operation occurs when the ram is retracted below a predetermined length and the second mode of operation occurs when the ram is extended beyond the predetermined length. When the ram is equal to the predetermined length, a portion of the mechanism which tilts the back and extends and retracts the leg rest abuts against a portion of the seat frame and transfers the force of the ram from the back and leg rest to the seat.

23 Claims, 12 Drawing Figures

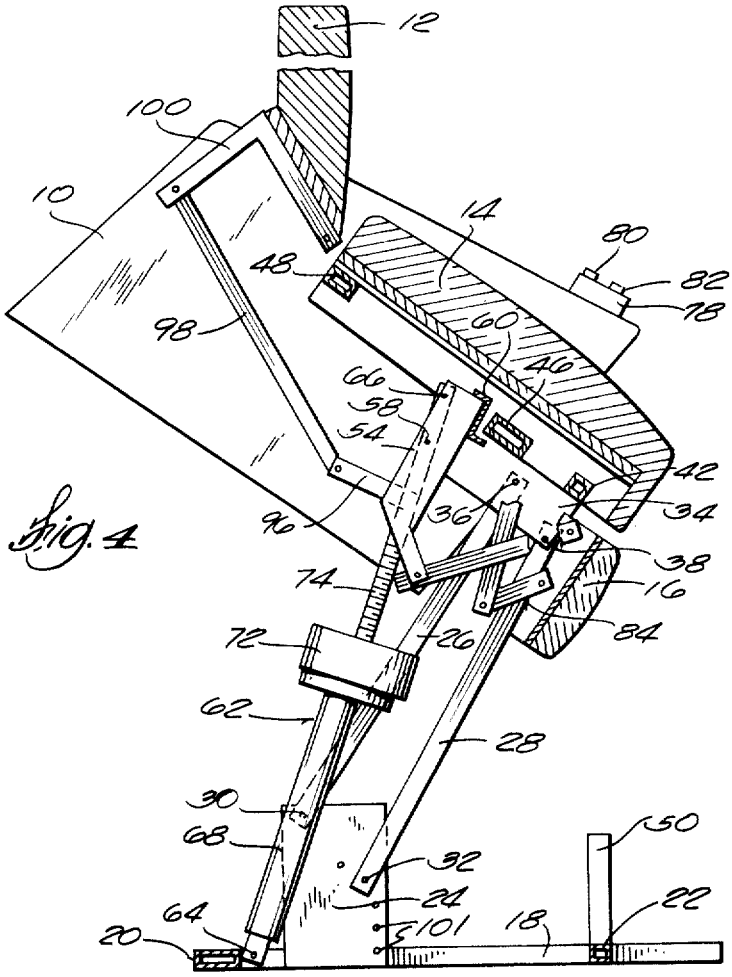
Fig. 4
Fig. 5
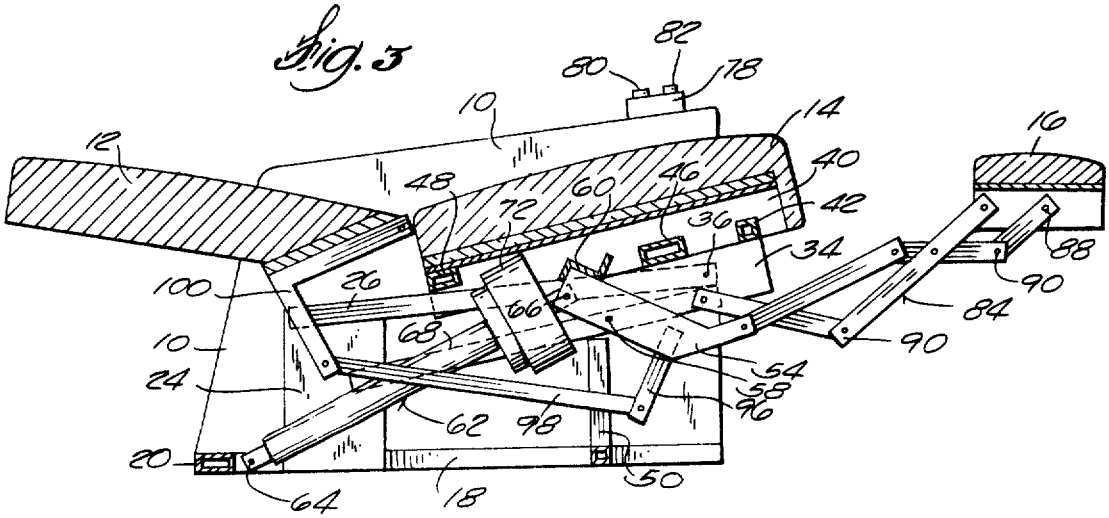

RECLINING ELEVATOR CHAIR

BACKGROUND OF THE INVENTION

This invention relates to power-driven reclining chairs and to power-driven elevator chairs. In reclining chairs a tiltable back is power driven between an erect and a reclined position while at the same time an extendible leg rest is power driven between a retracted and an extended position. In elevator chairs the seat is power driven between a normal position and a raised position while at the same time the seat is tilted slightly forward.

SUMMARY OF THE INVENTION

In accordance with this invention, reclining and elevating mechanism is incorporated in the same chair and a single power-actuated drive means is used to power drive both the reclining mechanism and the elevating mechanism. In a first mode of operation, the drive means drives the reclining mechanism to tilt the back of the chair and extend and retract the leg rest. In a second mode of operation, the drive means drives the elevator mechanism to raise the seat of the chair and tilt it slightly forward. Near the upper end of the elevation of the chair seat, mechanism is effective to tilt the seat back rearwardly to avoid imposition of ejecting pressure on the occupant of the chair.

The transfer between the first and second modes of operation is effectuated by the disclosed structure in which a ram acts through part of its range of extension to swing a crank about its pivot to drive the recliner mechanism in the first mode. When the ram acts through a different part of its range, it abuts the crank against the seat frame to inactivate the recliner mechanism and drives the elevating mechanism in the second mode.

Other objects, features and advantages of the invention will appear from the disclosure hereof.

DESCRIPTION OF THE DRAWINGS

FIG. 3 is a cross section similar to FIG. 2 with the back in its reclined position, the seat in its normal position, and the leg rest in its extended position.

FIG. 4 is a cross section similar to FIG. 2, but in which the chair has been substantially fully elevated.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
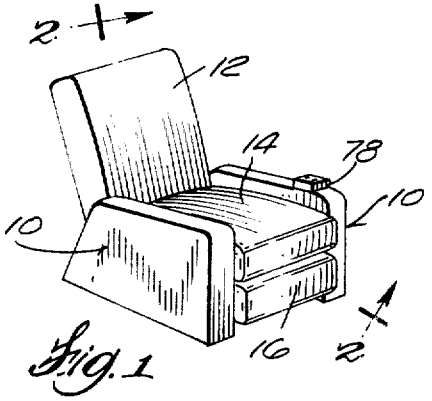
FIG. 1 is a reduced scale perspective view of one embodiment of the invention.

FIG. 1 is a perspective view of one embodiment of a chair embodying the invention. The chair has two sides 10, a tiltable back 12, a raisable seat 14, and an extendible leg rest 16. In its normal or erect position, shown in FIGS. 1 and 2, back 12 is tilted slightly backwardly from the vertical for the comfort of the person sitting in the chair. Seat 14 is normally tilted slightly downwardly and rearwardly from the horizontal (FIG. 2) for the same reason.

Figure 11:
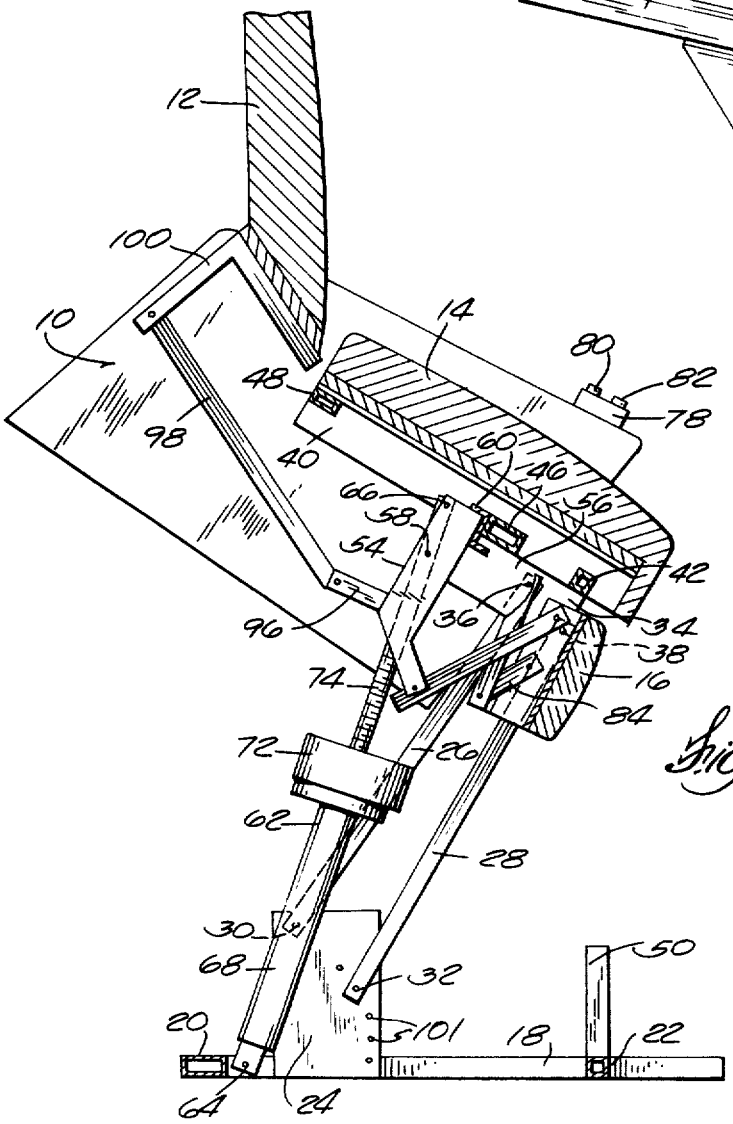
FIG. 11 is a cross section similar to FIGS. 2 and 4, but in which the chair has been partially elevated.

The chair of this invention includes a power-actuated drive means, to be described later, which is common to both the recliner means and to the elevator means and which operates in a first mode of operation to drive recliner actuator means or mechanism to tilt back 12 to a reclined position (FIG. 3) and to simultaneously extend and tilt leg rest 16. The drive means may be stopped at any desired position of back 12 and leg rest 16 between the two extremes shown in FIGS. 2 and 3. In a second mode of operation the same drive means drives elevator means or mechanism to raise seat 14 and tilt it forwardly as shown in FIGS. 4 and 11. Sides 10, back 12, and leg rest 16 rise along with seat 14 in the second mode of operation. The reclining action is for the comfort of the user, while the lifting action is to assist arthritic, elderly or partially disabled persons in getting up to leave the chair.

Figure 2:
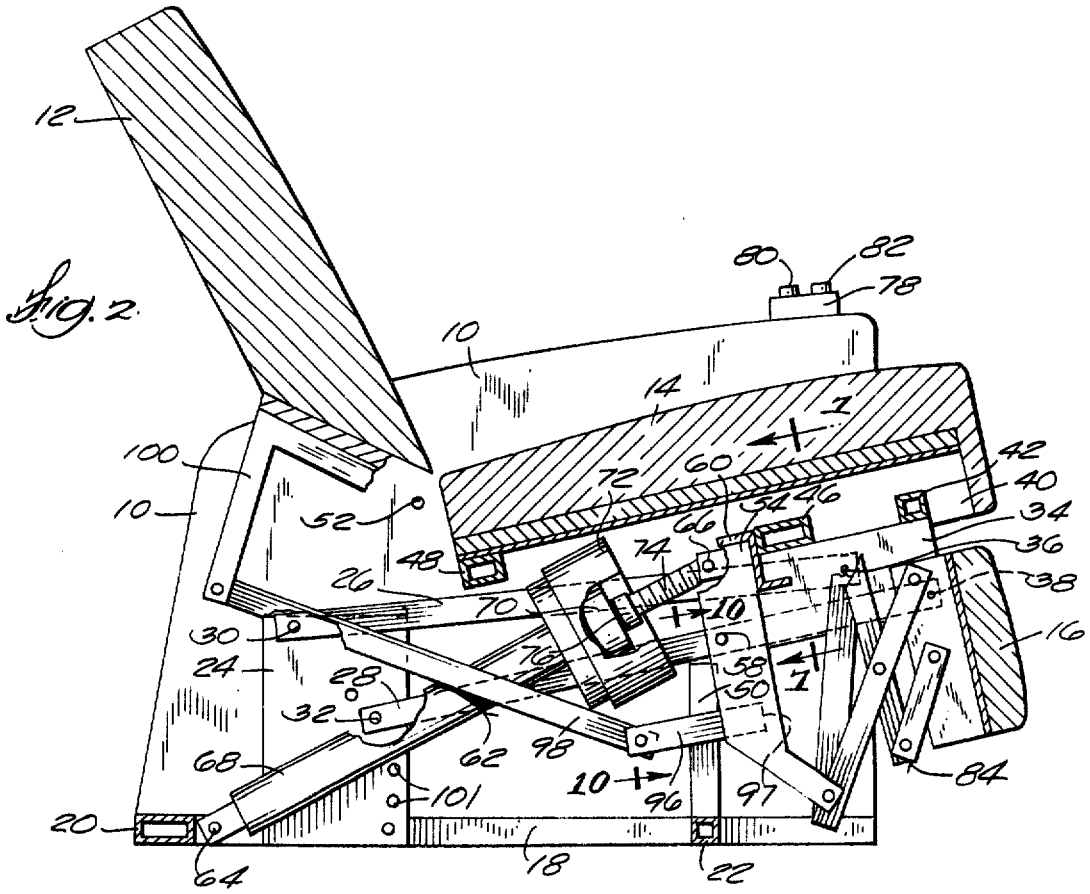
FIG. 2 is a cross section along the line 2—2 of FIG. 1 with the back in its erect position, the seat in its normal position, and the leg rest in its retracted position.
Figure 6:
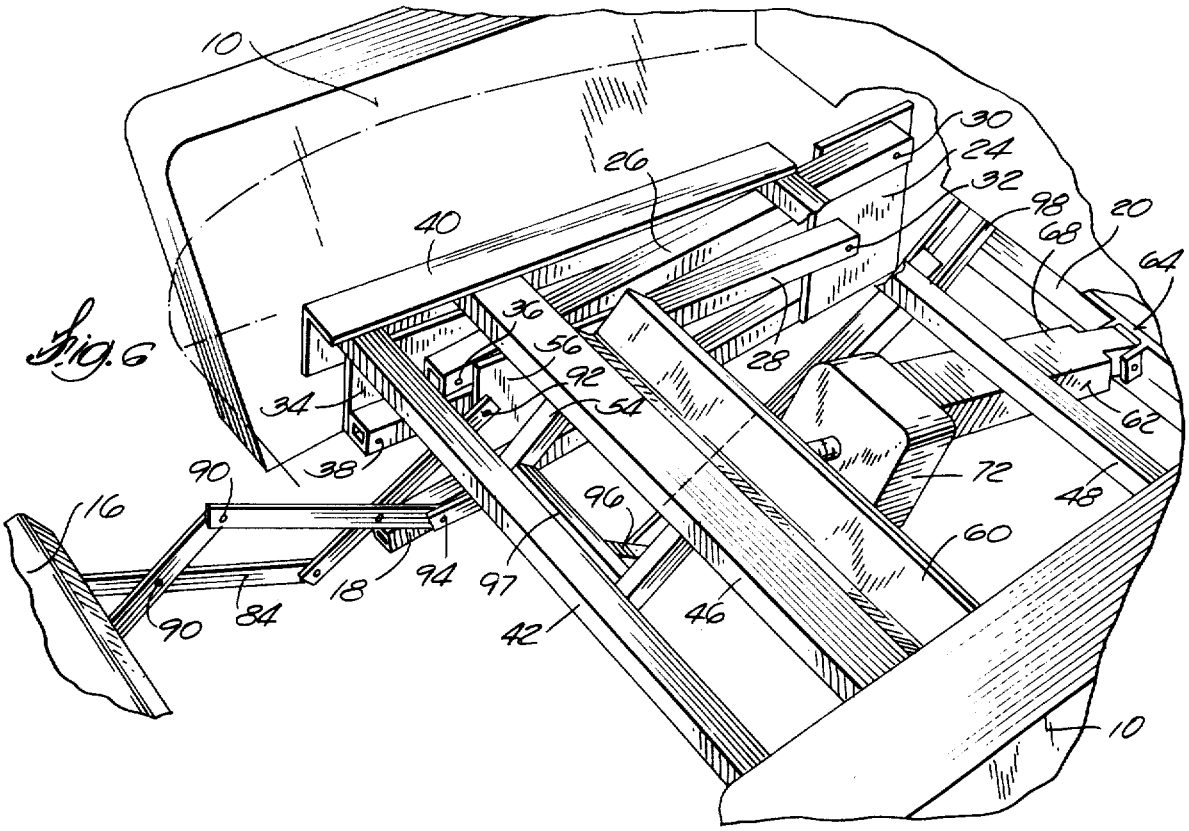
FIG. 6 is a fragmentary perspective view similar to FIG. 5 with the seat frame in its normal position and the leg rest in its extended position, the near side of the leg rest support being cut away.
Figure 5:
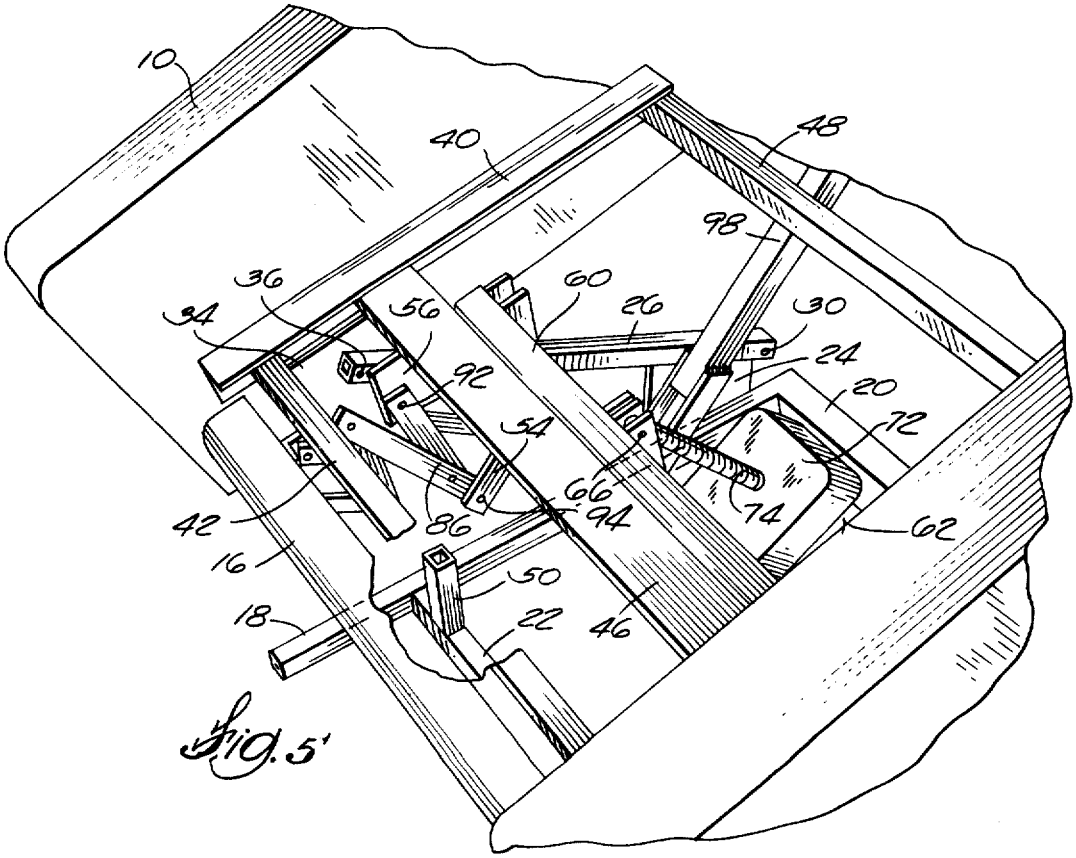
FIG. 5 is a fragmentary perspective view of the chair frame and portions of the power drive apparatus and linkages as seen from above with the seat removed, the seat frame in its normal position and the leg rest in its retracted position.

Referring to FIGS. 2, 4 and 5, the chair comprises a base frame including two spaced apart side rails 18, one of which is shown in FIGS. 2–4, and the other of which is shown in FIGS. 5 and 6. Side rails 18 are rigidly joined together by a rear stretcher 20 and a forward stretcher 22. Side rails 18 and stretchers 20 and 22 are preferably made of hollow rectangular steel tubing and are welded together to form a sturdy rigid base for the chair.

Figure 9:
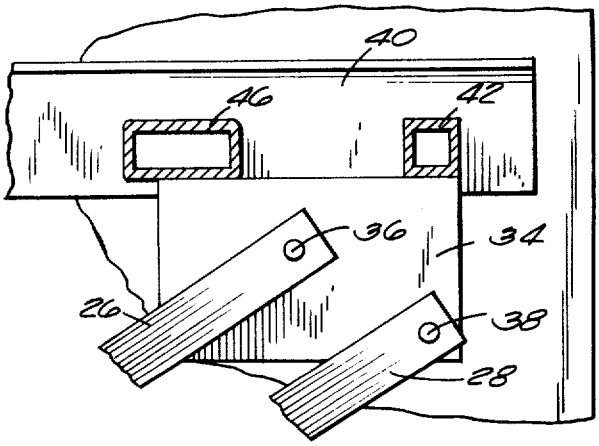
FIG. 9 is a fragmentary cross section view taken on the line 9—9 of FIG. 7.

A pair of laterally spaced upstanding support plates 24, one of which is shown in FIGS. 2–4 and the other of which is shown in FIGS. 5 and 6, are welded to the rear portions of side rails 18 and project upwardly therefrom. The elevator means or mechanism includes two sets of paired laterally spaced arms 26 and 28 pivotally connected at their rear ends by pintles 30, 32 to corresponding plates 24 at opposite sides of the chair. The forward ends of swing amrs 26 and 28 are pivotally connected to correspondingly laterally spaced seat support plates 34 (FIGS. 7 and 9) by pintles 36 and 38. Swing arms 26 and 28 are preferably made of hollow rectangular steel tubing and are sturdy enough to support their respective share of the maximum load on the chair both in the normal position of seat 14 (FIG. 2) and in the raised position thereof (FIG. 4).

Chair seat 14 is supported by a seat frame that includes two side rails 40, one of which is shown in FIGS. 2–4, 7 and 9, and the other of which is shown in FIGS.

Figure 10:
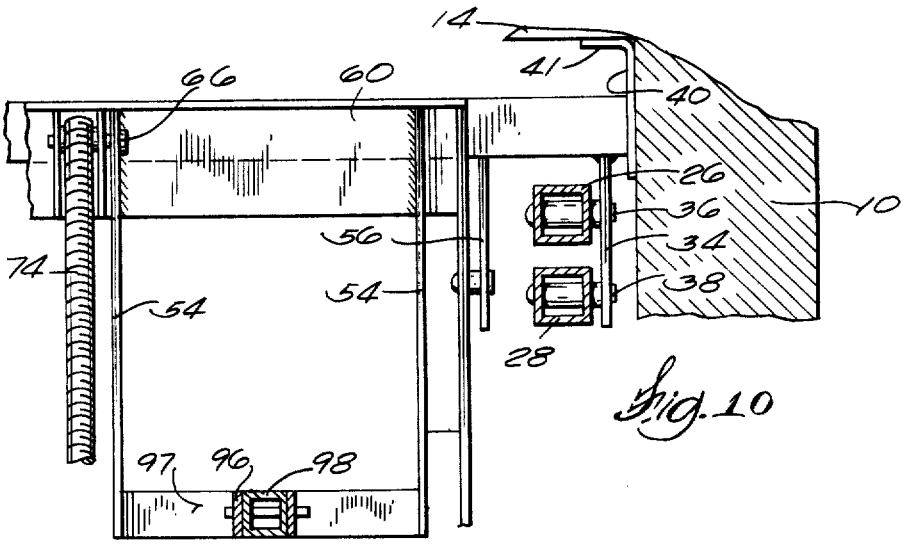
FIG. 10 is a fragmentary cross-section view taken on the line 10—10 of FIG. 2.

5, 6 and 10. Side rails 40 are rigidly joined together by stretchers 42, 46 and 48. Side rails 40 preferably comprise steel angle irons having top flat flanges 41 (FIGS. 7 and 10) which support seat 14. Stretchers 42, 46 and 48 preferably comprise hollow rectangular steel tubing and are welded to side rails 40. Seat support plates 34 are made of steel and are welded to the bottom of stretchers 42 and 46. One of the seat plates 34 is shown in FIGS. 2–4, 7 and 9 and the other is shown in FIGS. 5, 6 and 10.

In the normal position of the chair shown in FIG. 2, the weight of the chair and the person in it is borne by the seat frame 40, 42, 46, 48, the base frame 18, 20, 22, 24, and by support arms 26 and 28. In their lowermost position, support arms 28 are supported by a pair of riser posts 50 which are welded to base frame stretchers 22 and project upwardly therefrom. One riser 50 is shown in FIGS. 2–4 and the other is shown in FIG. 5. Both risers 50 are preferably made of rectangular steel tubing.

Seat frame side rails 40 are rigidly attached to chair sides 10 by conventional means not shown in the drawings. Back 12 is pivotally connected to sides 10 by conventional means including pivot pins 52 (FIG. 2) only one of which is shown in the drawings. Back 12 can be pivoted between an erect position, shown in FIG. 2, and a reclined position, shown in FIG. 3, and can be stopped in any intermediate position between these two extremes.

Figure 7:
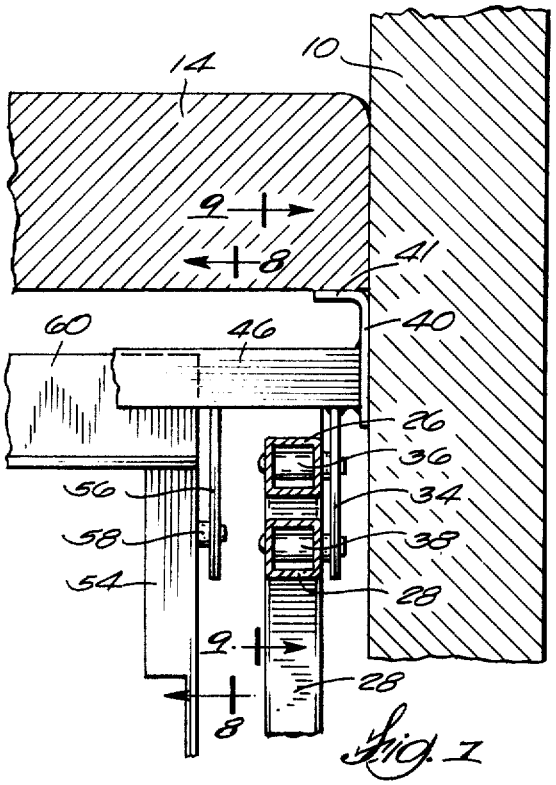
FIG. 7 is a fragmentary cross-sectional view taken on the line 7—7 of FIG. 2.
Figure 8:
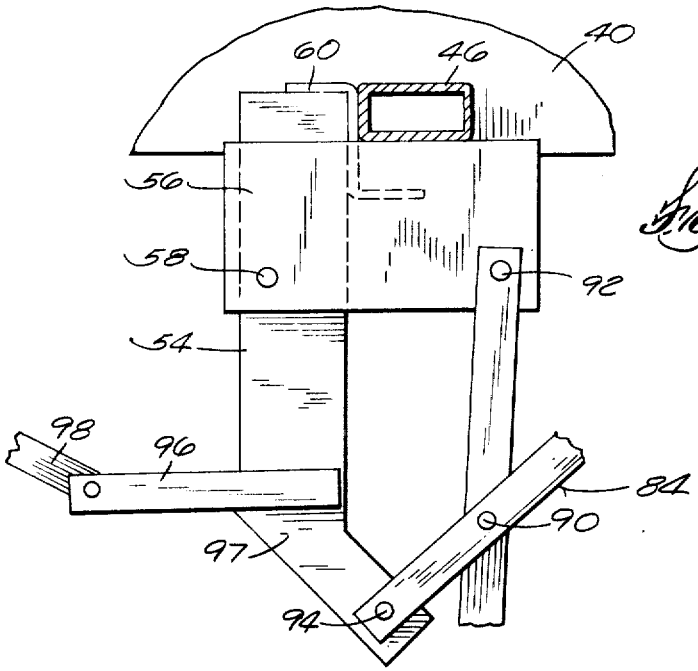
FIG. 8 is a fragmentary cross section taken on the line 8—8 of FIG. 7.

The recliner mechanism by which the back 12 is articulated includes back actuator means comprising linkage means including a pair of laterally spaced crank or rocker arms 54 pivotally connected by pivot pins 58 to laterally spaced support plates 56 (FIG. 7). One of the support plates 56 is shown in FIGS. 2–4, 7 and 8, and the other is shown in FIGS. 5, 6 and 10. Both support plates 56 are welded to the bottom of seat frame stretcher 46 and extend downwardly therefrom. The two laterally spaced rocker arms 54 welded at their upper front corners to a laterally extending abutment and thrust bar 60 which is Z-shaped in cross section. Rocker arms 54 and bar 60 pivot together about an axis through the two pivot pins 58, one of which is shown in FIG. 2–4 and 10 and the other of which is shown in FIGS. 7 and 8.

A power-actuated drive means including ram 62 is pivotally connected at one end to the center of base frame stretcher 20 on pivot pins 64 and at the other end to rocker arm stretcher 60 by pivot pin 66. Drive ram 62 includes a housing 68 which supports an electric motor 70, speed reducing gearing and drive means 72 attached to the end of housing 68, and a screw 74 which engages a conventional rotating drive nut 76 within drive means 72. As drive nut 76 is rotated by motor 70 through conventional gearing in drive means 72, screw 74 is forcibly extended or retracted, depending on the direction of rotation of drive nut 76.

Motor 70 can be controlled for rotation in either direction to extend or retract the ram 62 at will by means of a switch assembly 78 (FIG. 2) which is mounted on top of one of the arms 10 and by suitable conductors, not shown, connecting motor 70 to an A.C. outlet and to switch assembly 78. The electrical circuit is a conventional motor control circuit and therefore is not disclosed in the drawings. Switch assembly 78 includes one momentary contact switch 80 which, when pressed, rotates motor 70 in a direction that causes screw 74 to extend, and another momentary contact switch 82 which, when pressed, rotates motor 70 in a direction that causes screw 74 to retract.

Although drive ram 62 is a motor-driven ram in this embodiment of the invention, other power-actuated drive means could be employed, such as hydraulic rams or pneumatic rams or the like. Any extendible and retractable ram which is sturdy enough to support the maximum load can be employed.

Leg or foot rest 16 is supported by a pair of laterally spaced extendible and retractable scissors or lazy tong linkages 84, one of which is shown in its retracted position in FIG. 2 and in its extended position in FIG. 3. The other scissors linkage 84 is shown in its retracted position in FIG. 5 and in its extended position in FIG. 6. Lazy tong linkages 84 consist of a plurality of links. Endmost forward links are pivotally connected on pintles 88 to leg rest 16 and are pivotally connected on pintles 90 to each other. The endmost links at the rear end of lazy tong linkages 84 are pivotally connected on pintle 92 to support plate 56 (FIGS. 5, 6 and 8) and on pintle 94 to the lower end of rocker arm 54.

When rocker arms 54 are pivoted counterclockwise in FIGS. 2 and 3, they cause the lazy tong linkages 84 to extend. When rocker arms 54 are pivoted clockwise in FIG. 2, they cause lazy tong linkages 84 to retract. When lazy tong linkages 84 extend, they extend leg rest 16 and simultaneously cause it to rotate counterclockwise in FIGS. 2 and 3 so that the outer surface of leg rest 16 is uppermost in the fully extended position shown in FIG. 3. Rotation of leg rest 16 is accomplished through the use of a conventional disposition of links of different lengths in the lazy tong linkages 84. The individual links of unequal length are joined together unsymmetrically in accordance with conventional practice to achieve the desired 90 degree tilt of leg rest 16 as it travels between its fully retracted and fully extended positions.

The tiltable chair back 12 is also linked to the crank or rocker arms 54 via a rigid crank arm 96 projecting from a fixed rail 97 which spans between the rocker arms 54. Link 98 (FIG. 2) is pivotally connected at one end to rigid arm 96 and is pivotally connected at the other end to an angle bracket 100 which is rigidly attached by conventional means to chair back 12. When rocker arms 54 pivot counterclockwise in FIG. 2, they cause back 12 to tilt backwardly, and when rocker arms 54 pivot clockwise in FIG. 2, they cause back 12 to tilt forwardly up to an upright position shown in FIG. 2. In this position thrust bar 60 engages seat frame stretcher 46.

The above-noted position of rocker arms 54 and rocker arm stretcher 60 is significant because at this position, rocker arms 54 and thrust bar 60 lock to the seat frame. Any further extension of power ram 62 causes the seat frame to rise and tilt forwardly while back 12 and leg rest 16 remain in the position shown in FIG. 2. This initiates the second mode of operation in which seat 14 will elevate to its position shown in FIG. 4. The upward and forward tilt of chair seat 14 is caused by a non-parallelogram linkage formed by support arms 26 and 28, support plates 24 and 34, and pivot pins 30, 32, 36 and 38. The upward force on this non-parallelogram linkage is communicated from power ram 62 to crank or rocker arms 54, Z-shaped bar 60 and from there through the abutting seat frame stretcher 46 to the seat frame 40.

The length of power ram 62 shown in FIG. 2 is the predetermined critical length which divides the operation of power ram 62 into two modes of operation. The first mode involves extension and retraction of ram 62 below the critical length. The second mode involves extension and retraction of ram 62 above the critical length.

In the first mode of operation, rocker arms 54 and rocker arm stretcher 60 rotate about pivot pins 58, either clockwise or counterclockwise, depending on the direction of rotation of motor 70, and cause back 12 to tilt one way or the other and leg rest 16 to extend and tilt one way or retract and tilt the other way. Pressure on motor control switch 82 causes back 12 to tilt downwardly and leg rest 16 to extend. Pressure on switch 80 causes back 12 to tilt upwardly and leg rest 16 to retract. During these movements seat 14, seat frame 40 and support arms 26, 28 remain fixed in position. Only rocker arms 54 and the linkages attached thereto swing about the axis of pivot pins 58.

In the second mode of operation, rocker arms 54 and abutment bar 60 are held by the pressure of ram 62 in fixed position with respect to seat 14 and seat frame 40. In this mode there is no pivotal movement of rocker arms 54 about pivot 58, until the chair is raised to its FIG. 11 position. The position of the parts shown in FIG. 2 can be characterized as a mode transfer position, inasmuch as retraction of ram 62 from this position places the mechanism in its first mode of operation and advance of ram 62 from this position places the mechanism in its second mode of operation.

The degree of upward tilt for seat 14 during the second mode of operation is determined in accordance with conventional practice by the dimensions of the non-parallelogram linkage arms 26 and 28 and the spacing between their pivot points 30, 32, 36 and 38. Additional holes 101 are provided in plate 24 for alternate receipt of pintle 32 for swing arm 28, thus to permit adjustment of the degree of tilt of seat 14 and the level of chair elevator at which seat back 12 will automatically be retracted, as hereinafter explained.

The above-noted transfer of the force of ram 62 from rocker arms 54 and rocker arm stretcher 60 to seat frame stretcher 46 enables a common motor 70, common motor-driven ram 62, common motor control circuit, and common motor control switches 80 and 82 to be used to power the chair in both modes of operation. When ram 62 is below its critical length, it automatically operates in the first mode. When ram 62 is above its critical length, it automatically operates in the second mode to function as an elevator drive means. Thus, the transfer from one mode of operation to the other is an inherent feature of the structural arrangement hereinbefore described in which ram pressure is transferred from the first mode in which crank arms 54 are swung about pivot 58 to the second mode in which seat 14 is swung upwardly on swing arms 26, 28.

In this connection, it should be noted that the required abutment at the transfer point could be effected through contact of any part of the rocker arm assembly and the seat frame assembly. For example, abutment brackets could be welded to the inside surfaces of support plates 56 (FIG. 7) in position to intercept rotation of rocker arms 54 when ram 62 reaches the critical length shown in FIG. 2.

Figure 12:
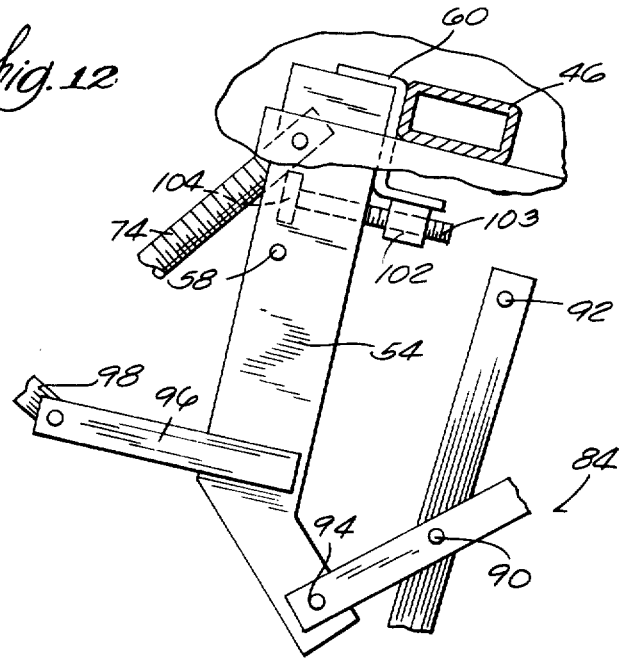
FIG. 12 is a cross section similar to FIG. 8, but showing a modification in which an adjustable abutment to relieve the crank of turning moment has been added.

FIGS. 4, 11 and 12 illustrate another feature of the invention pursuant to which means is provided to automatically actuate the recliner mechanism near the end of the second mode of ram operation so that the seat back 12 is tilted rearwardly to relieve pressure of the seat back against the seat occupant. Such pressure might prematurely eject the occupant from the seat. Accordingly, it has been found desirable to recline or tilt back the seat back 12 before the chair has been fully elevated. In most cases it is appropriate to start the rearward tilting of the seat back 12 when the chair has been elevated to about 80% of its full range of elevation. This position of the chair is shown in FIG. 11. The utilization of this feature could be at some other level in the partial elevation of the chair, as determined by which of the holes in the arcuate series of holes 101 in plate 24, pintle 32 for swing arm 28 is engaged.

In this connection, it is important that during the initial portion of the elevation of the chair there be a substantial moment arm between pintles 58 on which crank arms 54 are pivoted to plates 56 and the thrust axis of the ram 62. This thrust axis extends longitudinally of the ram 62, on the axis of ram screw 74. As best shown in FIGS. 2 and 3, there is a substantial moment arm between the thrust axis of the ram and pintle 58 in the FIGS. 2 and 3 position of the chair. Accordingly, continued thrust of the ram after Z-bar 60 has come into abutment with thrust bar 46 will transfer the force of the ram to the elevation mechanism in the second mode of operation of the ram. As long as the Z-bar abuts the thrust bar 46, crank 54 will have a fixed relationship to the seat 14 and the seat back 12 will remain in its fully upright position shown in FIGS. 2 and 11 and the foot rest 16 will be fully retracted as is also shown in these figures.

The spacial relationship between the parts, and particularly the pivot points 64, 66 of the ram 62 and the pivot points, 30, 36, 32, 38 for the two sets of swing arms 26, 28, is such that the moment arm between pintle 58 and the thrust axis of ram 62 will be gradually reduced as the chair swings upwardly. At the partially elevated position of the chair illustrated in FIG. 11, for example, about 80% of the full elevation of the chair, pintle 58 will come into alignment with the thrust axis of the ram 62, thus reducing said moment arm to zero. Accordingly, at this and higher elevations of the chair there will no longer be any turning moment exerted by the ram against the crank 54 tending to hold the Z-bar 60 in abutment with the abutment bar 46. As previously indicated, the spacial relation between the parts comprises means for relieving the crank of such turning moment.

However, at elevations of the chair higher than shown in FIG. 11, the seat 14 will continue its tilting motion in a forward direction because the sets of swing arms 26, 28 are effective to cause such tilting movement throughout the range of chair elevation. Accordingly, at such higher elevations, for example, when the chair reaches its full elevated position as illustrated in FIG. 4, seat 14 will be tilted farther forwardly than in its position shown in FIG. 11. However, because there no longer is a moment arm between pintle 58 and the thrust axis of ram 62, the ram then acts to maintain pintles 66 and 58 in alignment with the ram thrust axis, and because both the ram 62 and crank 54 swing counterclockwise with respect to seat 14 in moving from FIG. 11 position to FIG. 4 position, Z-bar 60 will be withdrawn from abutment with the thrust bar 46, as illustrated in FIG. 4.

The principal effect of this counterclockwise pivotal movement of crank 54 is to swing seat back 12 rearwardly to a partially reclined position, thus to remove the force of the seat back against the seat occupant and avoid imposition of premature ejection pressure on the occupant of the seat. Concurrently, the foot rest 16 is also projected slightly forwardly as shown in FIG. 4, but this is of no particular consequence.

If it is desired to start retracting or tilting seat back 12 rearwardly before the parts reach their positions shown in FIG. 11, the modification illustrated in FIG. 12 may be utilized. In this modification the Z-bar 60 is provided with a depending bracket 102 which is tapped to receive a threaded rod 103 having a large abutment head 104 which is aligned with the ram screw 74. In the position of the parts illustrated in FIG. 12, head 104 of screw 103 has come into contact with the ram screw 74 in the course of raising the seat and before the FIG. 11 position has been reached. FIG. 12 illustrates approximately the 60% lifted position of the chair. Now the crank 54 has been relieved of the turning moment which would otherwise be produced by the moment arm between pintle 58 and the thrust axis of ram 62 so that on further elevation of the chair beyond the level illustrated in FIG. 12, crank 54 will turn counterclockwise about pintle 58 to actuate the reclining mechanism which tilts the seat back 12 rearwardly.

The position of the threaded rod 103 in bracket 102 is readily adjusted for the purpose of adjusting the point at which the crank is relieved of the turning moment caused by the ram. Accordingly, the abutment mechanism of FIG. 12 permits adjustment of the parts to start rearward tilting of the seat back 12 at any desired level of elevation of the chair, depending on the personal requirements and preferences of the user.

From the foregoing it is clear that means are provided to relieve the crank of the turning moment of the ram. In the embodiment shown in FIG. 11, this means is the spacial relation of the parts pursuant to which pintles 58 and 66 come into alignment with the thrust axis of ram 62. In the embodiment of FIG. 12 this means is the abutment 104 which prevents crank 54 from turning with respect to ram 62 after the abutment 104 contacts ram screw 74.

What is claimed is:

1. In a reclining chair having a frame, a back portion, a seat portion, a leg rest portion, recliner actuator means including means for swinging said back portion between an upright and a reclined position and means for moving said leg rest portion between an extended and a retracted position, the improvement comprising elevator means for raising said seat and simultaneously tilting said seat forwardly to assist exit from said chair, and power-actuated drive means common to both the recliner actuator means and the elevator means for sequentially actuating both the recliner actuator means and the elevator means and being operable sequentially in a first mode of operation to drive the recliner actuator means to swing said back portion between its upright and reclined positions and to simultaneously move said leg rest between its retracted and extended positions while said seat is in its lowered position, and operable in a second mode of operation to drive the elevator means to raise and tilt said seat forwardly, said power actuator drive means comprising a crank connected to said recliner actuator means, and abutment means connected to the elevator means and disposed in the path of crank movement to transfer the force of said drive means from the recliner actuator means to the elevator means at a transfer point between said first and second modes of operation, said power-actuated drive means comprising an extendible and retractable ram pivotally connected at one end to said frame and pivotally connected at the other end to said crank.

2. The apparatus of claim 1 in which said elevator means comprises swing arms linked between said seat and said frame.

3. The apparatus of claim 2 in which said swing arms comprise non-parallelogram linkages which tilt the seat forwardly as it is lifted.

4. The apparatus of claim 1 wherein said seat portion includes a seat frame, and wherein said crank comprises a pair of rocker arms pivotally connected to said seat frame and a thrust bar attached to said rocker arms and extending therebetween, said abutment means comprising said seat frame having a part positioned to abut against said thrust bar in said second mode of operation.

5. The reclining lift chair defined in claim 1 wherein said ram comprises a screw, a rotatable nut engaging said screw, an electric motor for rotating said nut to extend or retract said screw, and means for controlling the operation of said electric motor.

6. The apparatus of claim 3 wherein said seat portion includes several support plates projecting downwardly therefrom, said non-parallelogram linkages being pivotally connected at one end to one of said support plates and said crank being pivotally connected to another of said support plates.

7. In a reclining chair having a frame, a back portion, a seat portion, a leg rest portion, recliner actuator means including means for swinging said back portion between an upright and a reclined position and means for moving said leg rest portion between an extended and a retracted position, the improvement comprising elevator means for raising said seat and simultaneously tilting said seat forwardly to assist exit from said chair, and power-actuated drive means common to both the recliner actuator means and the elevator means for sequentially actuating both the recliner actuator means and the elevator means and being operable sequentially in a first mode of operation to drive the recliner actuator means to swing said back portion between its upright and reclined positions and to simultaneously move said leg rest between its retracted and extended positions while said seat is in its lowered position, and operable in a second mode of operation to drive the elevator means to raise and tilt said seat forwardly, said power-operated drive means comprising an extensible ram which extends in one range during said first mode of operation and in another range in said second mode of operation.

8. The apparatus of claim 7 in which the ram has a predetermined length at the transfer point between said first and second modes of operation.

9. In a reclining chair having a frame, a back portion, a seat portion, recliner actuator means including means for swinging said back portion between an upright and a reclined position, the improvement comprising elevator means for raising said seat and also tilting said seat forwardly to assist exit from said chair, and poweractuated drive means common to both the recliner actuator means and the elevator means for sequentially actuating both the recliner actuator means and the elevator means and being operable sequentially in a first mode of operation to drive the recliner actuator means and operable in a second mode of operation to drive the elevator means, said power-operated drive means comprising an extensible ram which extends in one range during said first mode of operation and in another range in said second mode of operation.

10. The apparatus of claim 9 in which said power actuator drive means comprises a crank connected to said recliner actuator means, and abutment means connected to the elevator means and disposed in the path of crank movement to transfer the force of said drive means from the recliner actuator means to the elevator means at a transfer point between said first and second modes of operation.

11. The apparatus of claim 10 wherein said ram is pivotally connected at one end of said frame and pivotally connected at the other end to said crank.

12. The apparatus of claim 11 wherein said seat portion includes a seat frame, and wherein said crank comprises a pair of rocker arms pivotally connected to said seat frame and a thrust bar attached to said rocker arms and extending therebetween, said abutment means comprising said seat frame having a part positioned to abut against said thrust bar in said second mode of operation.

13. The apparatus of claim 9 in which the ram has a predetermined length at the transfer point between said first and second modes of operation.

14. The apparatus of claim 11 in which the crank is connected on a pintle to said seat portion, the thrust axis of said ram being offset from said pintle so that a moment arm between said pintle and said axis exerts turning moment on the crank to force the crank against said abutment means during a first portion of said second mode of operation, and means for relieving the crank of said turning moment during a second portion of said second mode of operation and freeing said recliner actuator means for reclining the seat back during said second portion to avoid imposing ejecting force on the occupant of the seat.

15. The apparatus of claim 14 in which the means for relieving the crank of said turning movement comprises a spacial relation between said thrust axis and said pintle such that said thrust axis comes into alignment with said pintle at the end of said first portion of said second mode of operation, thus to reduce said moment arm to zero.

16. The apparatus of claim 14 in which the means for relieving the crank of said turning moment comprises an abutment between said crank and said ram whereby the crank is prevented from turning with respect to the ram at the end of said first portion of said second mode of operation.

17. The apparatus of claim 16 in which said abutment is adjustable whereby to adjust the level of chair elevation at which the crank is relieved of said turning moment.

18. The apparatus of claim 14 in which the elevator means comprises swing arms linked between said seat portion and said frame and which cause tilting of the seat portion throughout said second mode of operation.

19. A chair having a frame, a back portion, a seat portion, back actuator means including a crank for swinging said back portion between various positions respecting the seat portion, elevator means for raising said seat and also tilting said seat forwardly to assist exit from the chair, elevator drive means including an extendible and retractable ram pivotally connected at one end to the frame and pivotally connected at the other end to said crank, said crank being connected on a pintle to said seat portion and an abutment on the seat portion in the path of crank movement to impose the thrust of the ram on the seat portion to drive the elevator means, the thrust axis of the ram being offset from said pintle so that a moment arm between said pintle and said axis exerts turning moment on the crank to force the crank against said abutment during a first portion of elevation of the chair, and means for relieving the crank of said turning moment during a second portion of elevation of the chair and freeing said back actuator means for swinging said back portion rearwardly during said second portion to avoid imposition of ejecting pressure on the occupant of the chair.

20. The apparatus of claim 19 in which the means for relieving the crank of said turning moment comprises a spacial relation between said thrust axis and said pintle such that said axis comes into alignment with said pintle at the end of said first portion, thus to reduce said moment arm to zero.

21. The apparatus of claim 19 in which the means for relieving the crank of said turning moment comprises an abutment between said crank and said ram whereby the crank is prevented from turning with respect to the ram at the end of said first portion.

22. The apparatus of claim 21 in which the abutment is adjustable to adjust the level of chair elevation at which the crank is relieved of said turning moment.

23. The apparatus of claim 19 in which the elevator means comprises swing arms linked between said seat portion and said frame and which causes tilting of the seat portion throughout its said elevation.

* * * * *